US006401889B1

(12) United States Patent
McCleskey

(10) Patent No.: US 6,401,889 B1
(45) Date of Patent: Jun. 11, 2002

(54) LUGGAGE LOCK COVERING DEVICE

(76) Inventor: Rren P. McCleskey, 871 Glider Pl., San Jacinto, CA (US) 92582-6223

( * ) Notice: Subject to any disclaimer, the term of this patent is extended or adjusted under 35 U.S.C. 154(b) by 51 days.

(21) Appl. No.: 09/709,271

(22) Filed: Nov. 10, 2000

(51) Int. Cl.[7] ..... A45C 13/18; A45C 3/00

(52) U.S. Cl. ..... 190/102; 190/101; 190/120; 150/145; 150/129; 150/133; 150/134; 150/141

(58) Field of Search ..... 190/101, 102, 190/108, 119, 120; 150/127, 129, 132, 133, 145, 103, 147, 131, 141

(56) References Cited

U.S. PATENT DOCUMENTS

| | | | | | |
|---|---|---|---|---|---|
| 1,146,524 | A | * | 7/1915 | Rolfs | 150/143 X |
| 2,434,473 | A | * | 1/1948 | Stock | 150/131 |
| 2,711,234 | A | | 6/1955 | Rubens | |
| 2,746,504 | A | * | 5/1956 | Powell | 150/143 |
| 3,955,656 | A | | 5/1976 | Kashinski | |
| 4,134,280 | A | | 1/1979 | Pelavin | |
| 4,286,639 | A | * | 9/1981 | Murphy | 150/131 X |
| 4,397,378 | A | | 8/1983 | Lee | |
| 4,570,688 | A | * | 2/1986 | Williams | 150/134 |
| 4,700,818 | A | | 10/1987 | Orwin | |
| 4,744,497 | A | * | 5/1988 | O'Neal | 150/149 |
| 5,257,656 | A | * | 11/1993 | McLeroy | 150/132 |
| 5,653,276 | A | * | 8/1997 | Niernberger | 150/137 |
| D401,137 | S | | 11/1998 | Boelling | |
| 6,112,961 | A | * | 9/2000 | Phillips | 224/222 |

* cited by examiner

*Primary Examiner*—Allan N. Shoap
*Assistant Examiner*—Tri M. Mai

(57) ABSTRACT

A luggage lock covering device for protecting a luggage lock from damage as well as protecting the luggage from damage caused by-the luggage lock. The luggage lock covering device includes a panel having a plurality of fold indentations therein such that a first portion, a second portion and a third portion are defined. The second portion is positioned between the first and third portions. The second portion includes an elongated slot extending therethrough. The elongated slot includes a size designed for removably receiving the luggage zipper. There is a fastening means for removably coupling the first portion to the third portion. The fastening means comprises a hook and loop fastening means that includes a loop portion and a hook portion.

9 Claims, 2 Drawing Sheets

LUGGAGE LOCK COVERING DEVICE

BACKGROUND OF THE INVENTION

1. Field of the Invention

The present invention relates to luggage accessories and more particularly pertains to a new luggage lock covering device for protecting a luggage lock from damage as well as protecting the luggage from damage caused by the luggage lock.

2. Description of the Prior Art

The use of luggage accessories is known in the prior art. More specifically, luggage accessories heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 3,955,656; U.S. Pat. No. 4,397,378; U.S. Pat. No. 2,711,234; U.S. Pat. No. 4,700,818; U.S. Pat. No. 4,134,280; and U.S. Pat. No. Des. 401,137.

While these devices fulfill their respective, particular objectives and requirements, the aforementioned patents do not disclose a new luggage lock covering device. The inventive device includes a panel. The panel includes a top surface, a bottom surface, a first edge, a second edge, a third edge and a fourth edge. The panel includes a plurality of fold indentations therein and extending between the first and second edges such that a first portion, a second portion and a third portion are defined. The second portion is positioned between the first and third portions. The second portion includes an elongated slot extending therethrough, the elongated slot includes a size designed for removably receiving the luggage zipper. There is a fastening means for removably coupling the first portion to the third portion. The fastening means comprises a hook and loop fastening means includes a loop portion and a hook portion. The loop portion is securably attached to the top surface of the first portion and positioned generally adjacent to the third edge. The hook portion is securably attached to the bottom surface of the third portion and positioned generally adjacent to the second portion.

In these respects, the luggage lock covering device according to the present invention substantially departs from the conventional concepts and designs of the prior art, and in so doing provides an apparatus primarily developed for the purpose of protecting a luggage lock from damage as well as protecting the luggage from damage caused by the luggage lock.

SUMMARY OF THE INVENTION

In view of the foregoing disadvantages inherent in the known types of luggage accessories now present in the prior art, the present invention provides a new luggage lock covering device construction wherein the same can be utilized for protecting a luggage lock from damage as well as protecting the luggage from damage caused by the luggage lock.

The general purpose of the present invention, which will be described subsequently in greater detail, is to provide a new luggage lock covering device apparatus and method which has many of the advantages of the luggage accessories mentioned heretofore and many novel features that result in a new luggage lock covering device which is not anticipated, rendered obvious, suggested, or even implied by any of the prior art luggage accessories, either alone or in any combination thereof.

To attain this, the present invention generally comprises a panel. The panel includes a top surface, a bottom surface, a first edge, a second edge, a third edge and a fourth edge. The panel includes a plurality of fold indentations therein and extending between the first and second edges such that a first portion, a second portion and a third portion are defined. The second portion is positioned between the first and third portions. The second portion includes an elongated slot extending therethrough. The elongated slot includes a size designed for removably receiving the luggage zipper. There is a fastening means for removably coupling the first portion to the third portion. The fastening means comprises a hook and loop fastening means includes a loop portion and a hook portion. The loop portion is securably attached to the top surface of the first portion and positioned generally adjacent to the third edge. The hook portion is securably attached to the bottom surface of the third portion and positioned generally adjacent to the second portion.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new luggage lock covering device apparatus and method which has many of the advantages of the luggage accessories mentioned heretofore and many novel features that result in a new luggage lock covering device which is not anticipated, rendered obvious, suggested, or even implied by any of the prior art luggage accessories, either alone or in any combination thereof.

It is another object of the present invention to provide a new luggage lock covering device which may be easily and efficiently manufactured and marketed.

It is a further object of the present invention to provide a new luggage lock covering device which is of a durable and reliable construction.

An even further object of the present invention is to provide a new luggage lock covering device which is susceptible of a low cost of manufacture with regard to both materials and labor, and which accordingly is then susceptible of low prices of sale to the consuming public, thereby making such luggage lock covering device economically available to the buying public.

Still yet another object of the present invention is to provide a new luggage lock covering device which provides in the apparatuses and methods of the prior art some of the advantages thereof, while simultaneously overcoming some of the disadvantages normally associated therewith.

Still another object of the present invention is to provide a new luggage lock covering device for protecting a luggage lock from damage as well as protecting the luggage from damage caused by the luggage lock.

Yet another object of the present invention is to provide a new luggage lock covering device which includes a panel. The panel includes a top surface, a bottom surface, a first edge, a second edge, a third edge and a fourth edge. The panel includes a plurality of fold indentations therein and extending between the first and second edges such that a first portion, a second portion and a third portion are defined. The second portion is positioned between the first and third portions. The second portion includes an elongated slot extending therethrough. The elongated slot includes a size designed for removably receiving the luggage zipper. There is a fastening means for removably coupling the first portion to the third portion. The fastening means comprises a hook and loop fastening means includes a loop portion and a hook portion. The loop portion is securably attached to the top surface of the first portion and positioned generally adjacent to the third edge. The hook portion is securably attached to the bottom surface of the third portion and positioned generally adjacent to the second portion.

Still yet another object of the present invention is to provide a new luggage lock covering device that would reduce the possibility of a luggage lock or luggage zipper from becoming damaged as to increase the life of the luggage.

Even still another object of the present invention is to provide a new luggage lock covering device that can function as a nametag, thereby, identifying the owner of the luggage.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
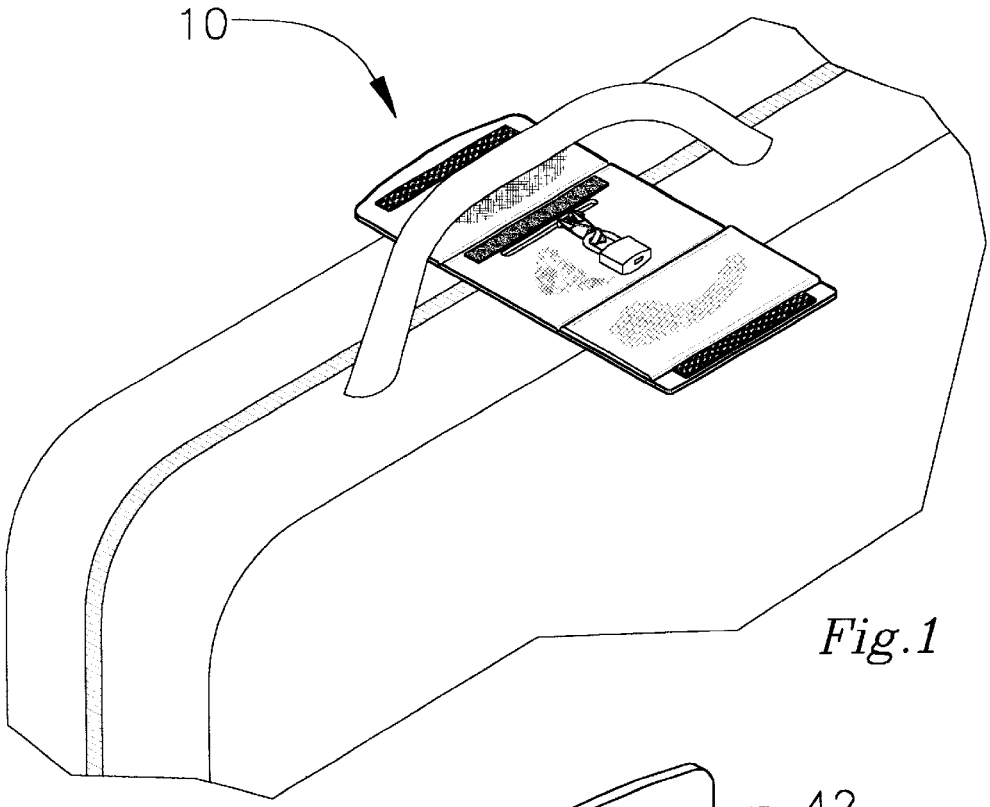
FIG. 1 is a schematic perspective view of a new luggage lock covering device according to the present invention.
Figure 2:
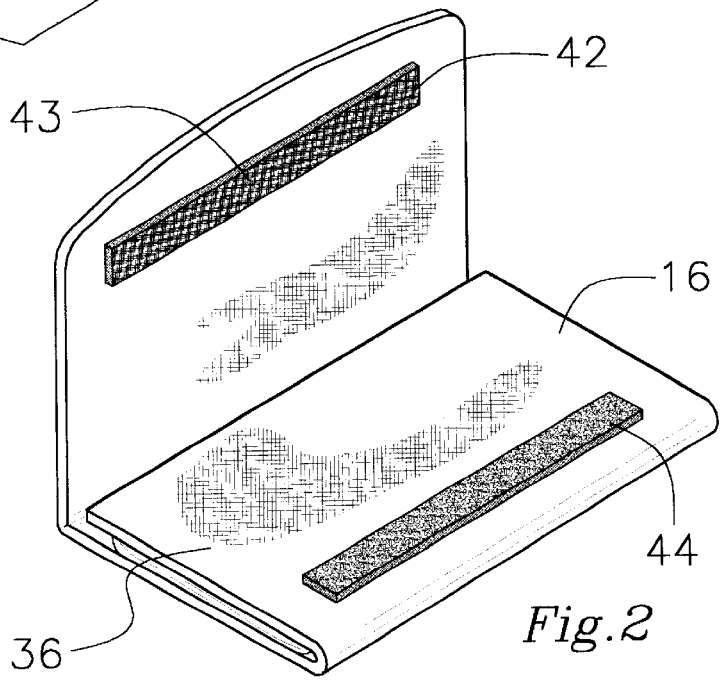
FIG. 2 is a schematic perspective view of the present invention.
Figure 3:
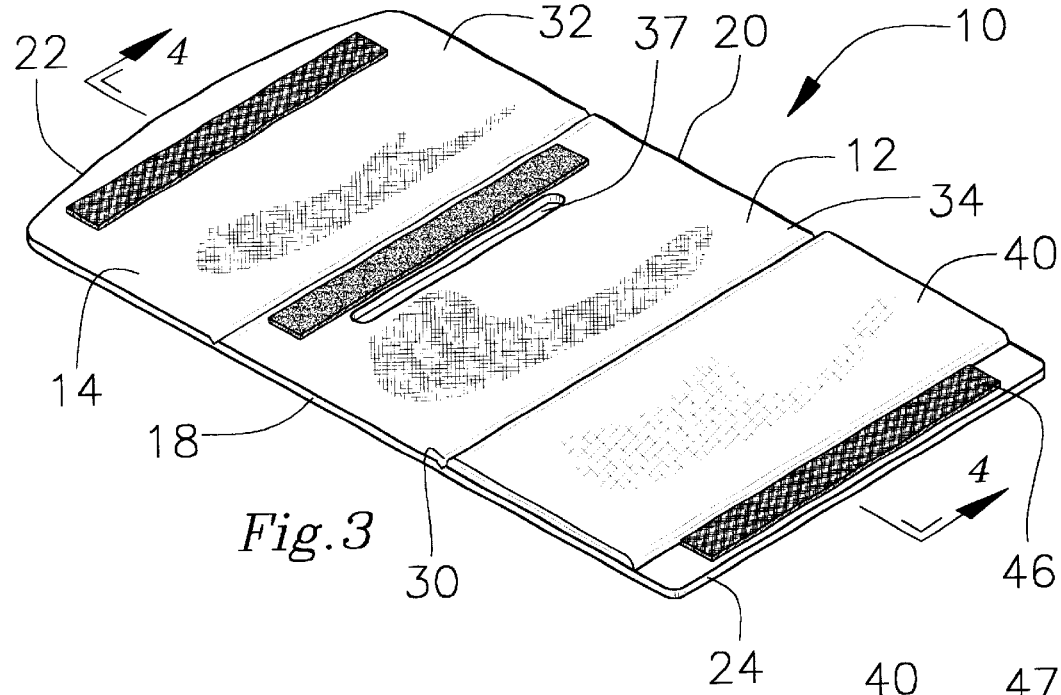
FIG. 3 is a schematic perspective view of the present invention.
Figure 4:
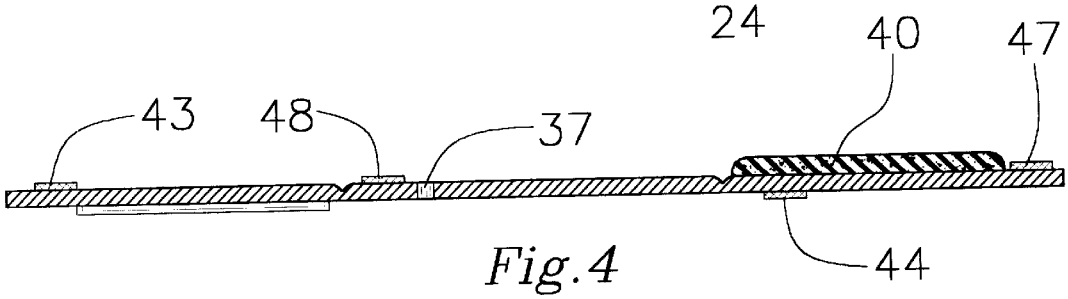
FIG. 4 is a schematic cross-sectional view of the present invention taken along line 4—4.
Figure 5:
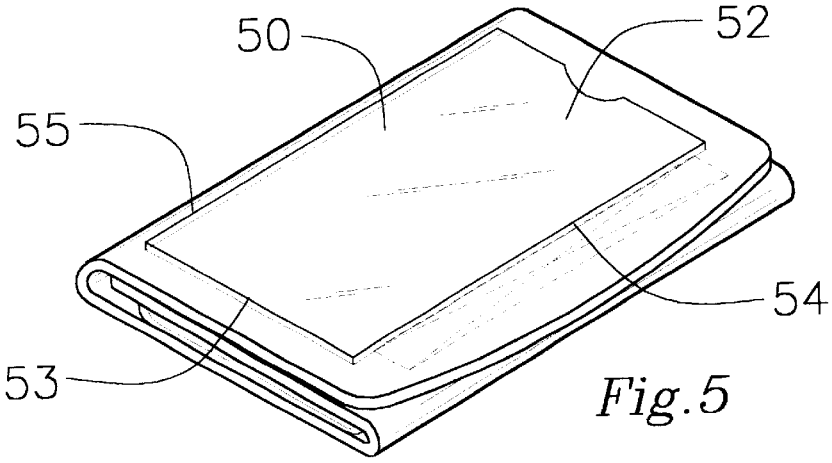
FIG. 5 is a schematic perspective view of the present invention showing the invention in a closed position.

With reference now to the drawings, and in particular to FIGS. 1 through 5 thereof, a new luggage lock covering device embodying the principles and concepts of the present invention and generally designated by the reference numeral 10 will be described.

As best illustrated in FIGS. 1 through 5, the luggage lock covering device 10 generally comprises a panel 12. The panel 12 a includes a top surface 14, a bottom surface 16, a first edge 18, a second edge 20, a third edge 22 and a fourth edge 24. The first and second edges 18 and 20 are orientated generally parallel to one another. The third and fourth edges 22 and 24 are orientated generally perpendicular to the first and second edges 18 and 20. The third and fourth edges 22 and 24 generally include a length equal to half the length of the first and second edges 18 and 20.

The panel 12 includes a plurality of fold indentations 30 therein and extending between the first and second edges 18 and 20 such that a first portion 32, a second portion 34 and a third portion 36 are defined. The second portion 34 is positioned between the first and third portions 32 and 36. The second portion 34 includes an elongated slot 37 extending therethrough. The elongated slot 37 extends generally between the first and second edges 18 and 20 and is positioned generally adjacent to the first portion 32. The elongated slot includes a size designed for removably receiving the luggage zipper. The panel 12 comprises a resiliently flexible material such as cloth or plastic.

A padded member 40 is securably attached to the first side 14 of the panel 12 and is positioned generally between the fourth edge 24 and said second portion 34 such that the padded member 40 is attached to the third portion 36. The padded material 40 comprises a cloth or foam material.

There is a first fastening means 42 for removably coupling the first portion 32 to the third portion 36. The first fastening means 42 comprises a hook and loop fastening means that includes a loop portion 43 and a hook portion 44. The loop portion 43 is securably attached to the top surface 14 of the first portion 32 and positioned generally adjacent to the third edge 22. The hook portion 44 is securably attached to the bottom surface 16 of the third portion 36 and is positioned generally adjacent to the second portion 34.

There is also a second fastening means 46 for removably coupling the third portion 36 to the second portion 34. The second fastening means 46 comprises a hook and loop fastening means that includes a loop portion 47 and a hook portion 48. The loop portion 46 is securably attached to the top surface 14 of the third portion 36 and is positioned generally adjacent to the fourth edge 24. The hook portion 48 is securably attached to the top surface 14 of the second portion 34 and is positioned generally between the first portion 32 and the elongated slot 37.

A pocket 50 comprising a pane 52 that includes a first edge 53, a second edge 54 and a third edge 55 is integrally coupled to the bottom surface 16 of the first portion 32. The pocket 50 is positioned generally between the third edge 22 and the second portion 34. The pocket 50 comprises a resiliently flexible material such as plastic. The pocket 50 may also comprise of a clear material allowing objects inside the pocket to be observed without having to remove the objects and.

In use, the third portion 36 is folded over the luggage lock and removably fastened to the second portion 34. The first portion 32 is folded over and removably fastened to the third portion 36, thus, protecting the luggage lock.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A luggage lock covering device adapted for protecting a luggage lock attached to a zipper of a piece of luggage, said device comprising:

a panel having a top surface, a bottom surface, a first edge, a second edge, a third edge and a fourth edge, said panel having a plurality of fold indentations therein and extending between said first and second edges such that a first portion, a second portion and a third portion are defined, said second portion being positioned between said first and third portions, said third portion being foldable into a folded condition adjacent to said second portion and said first portion being foldable into a folded condition adjacent to said third portion in said folded condition thereof, said second portion having an elongated slot extending therethrough, said elongated slot having a size adapted for removably receiving the luggage zipper; and a first fastening means for releasably securing said third portion in said folded condition thereof; and a second fastening means for releasably securing said first portion in said folded condition thereof;

wherein said second fastening means releasably secures said third portion to said second portion in said folded condition thereof, said second fastening means comprising a first component mounted on a portion of said top surface on said third portion of said panel and a second component mounted on a portion of said top surface on said second portion of said panel; and wherein said first fastening means releasably secures said first portion to said third portion, said first fastening means comprising a first component mounted on a portion of said top surface on said first portion of said panel and a second component mounted on a portion of said bottom surface on said second portion of said panel.

2. The luggage lock covering device of claim 1, further comprising:

a padded member attached to said top surface of said panel and positioned generally adjacent to said second edge.

3. The luggage lock covering device of claim 2, wherein said padded member comprises a cloth material.

4. The luggage lock covering device of claim 1, wherein the components of said first fastening means comprise a hook and loop fastening means having a loop component and a hook component, a first one of said hook and loop components being attached to said top surface of said third portion and positioned generally adjacent to said fourth edge, a second one of said hook and loop components being attached to said top surface of said second portion and positioned generally between said first portion and said elongated slot.

5. The luggage lock covering device of claim 1, further comprising:

a pocket comprising a pane having a first edge, a second edge and a third edge, each of said edges being integrally coupled to said bottom surface of said first portion, said pocket being positioned generally between said third edge and said second portion such that said pocket is visible when said first and said third portions are each in said folded condition thereof.

6. The luggage lock covering device of claim 1, wherein the components of said second fastening means comprise a hook and loop fastening means having a loop component and a hook component, a first one of said loop and hook components being attached to said top surface of said first portion and positioned generally adjacent to said third edge, a second one of said hook and loop components being attached to said bottom surface of said third portion and positioned generally adjacent to said second portion.

7. The luggage lock covering device of claim 1, wherein said elongated slot is located toward said fold indention between said first and second portions of said panels.

8. The luggage lock covering device of claim 1, wherein said elongated slot is located adjacent to one of said components of said first securing means.

9. A luggage lock covering device adapted for protecting a luggage lock attached to a zipper of a piece of luggage, said device comprising:

a panel having a top surface, a bottom surface, a first edge, a second edge, a third edge and a fourth edge, said panel having a plurality of fold indentations therein and extending between said first and second edges such that a first portion, a second portion and a third portion are defined, said second portion being positioned between said first and third portions, said third portion being foldable into a folded condition adjacent to said second portion and said first portion being foldable into a folded condition adjacent to said third portion in said folded condition thereof, said second portion having an elongated slot extending therethrough, said elongated slot having a size adapted for removably receiving the luggage zipper; and a first fastening means for releasably securing said third portion in said folded condition thereof; and a second fastening means for releasably securing said first portion in said folded condition thereof;

wherein said second fastening means releasably secures said third portion to said second portion in said folded condition thereof, said second fastening means comprising a first component mounted on a portion of said top surface on said third portion of said panel and a second component mounted on a portion of said top surface on said second portion of said panel;

wherein said first fastening means releasably secures said first portion to said third portion, said first fastening means comprising a first component mounted on a portion of said top surface on said first portion of said panel and a second component mounted on a portion of said bottom surface on said second portion of said panel;

a padded member attached to said top surface of said panel and positioned generally adjacent to said second edge;

a pocket comprising a pane having a first edge, a second edge and a third edge, each of said edges being integrally coupled to said bottom surface of said first portion, said pocket being positioned generally between said third edge and said second portion such that said pocket is visible when said first and said third portions are each in said folded condition thereof;

wherein the components of said first fastening means comprise a hook and loop fastening means having a loop component and a hook component, a first one of said hook and loop components being attached to said top surface of said third portion and positioned generally adjacent to said fourth edge, a second one of said hook and loop components being attached to said top surface of said second portion and positioned generally between said first portion and said elongated slot;

wherein the components of said second fastening means comprise a hook and loop fastening means having a loop component and a hook component, a first one of said loop and hook components being attached to said top surface of said first portion and positioned generally adjacent to said third edge, a second one of said hook and loop components being attached to said bottom surface of said third portion and positioned generally adjacent to said second portion;

wherein said elongated slot is located toward said fold indention between said first and second portions of said panels; and wherein said elongated slot is located adjacent to one of said components of said first securing means.

* * * * *